US008366415B2

(12) United States Patent
Kang et al.

(10) Patent No.: US 8,366,415 B2
(45) Date of Patent: Feb. 5, 2013

(54) LINEAR COMPRESSOR

(75) Inventors: Yang-Jun Kang, Changwon-shi (KR); Young-Hoan Jeon, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 394 days.

(21) Appl. No.: 12/739,185

(22) PCT Filed: Oct. 9, 2008

(86) PCT No.: PCT/KR2008/005952

§ 371 (c)(1),
(2), (4) Date: Apr. 22, 2010

(87) PCT Pub. No.: WO2009/054631

PCT Pub. Date: Apr. 30, 2009

(65) Prior Publication Data

US 2010/0260629 A1 Oct. 14, 2010

(30) Foreign Application Priority Data

Oct. 24, 2007 (KR) ..... 10-2007-0107344

(51) Int. Cl.
*F04B 35/04* (2006.01)
*F04B 17/04* (2006.01)

(52) U.S. Cl. ..... 417/416; 417/312; 417/417

(58) Field of Classification Search ..... 417/416, 417/312, 417; 181/403, 229
See application file for complete search history.

(56) References Cited

U.S. PATENT DOCUMENTS

| | | | | |
|---|---|---|---|---|
| 2,473,103 | A * | 6/1949 | Lathers | 181/269 |
| 5,993,178 | A * | 11/1999 | Park et al. | 417/545 |
| 6,398,523 | B1 * | 6/2002 | Hur et al. | 417/417 |
| 6,413,057 | B1 | 7/2002 | Hong et al. | |
| 2006/0093498 | A1 * | 5/2006 | Kim | 417/417 |
| 2007/0040456 | A1 * | 2/2007 | Hansen et al. | 310/14 |

FOREIGN PATENT DOCUMENTS

DE 199 00 886 7/1999

OTHER PUBLICATIONS

International Search Report issued in PCT/KR2008/005952 dated Feb. 6, 2009.

* cited by examiner

*Primary Examiner* — Charles Freay
*Assistant Examiner* — Ryan Gatzemeyer
(74) *Attorney, Agent, or Firm* — KED & Associates LLP

(57) ABSTRACT

A linear compressor is provided that includes a shell; a fixed member installed inside the shell, and including a cylinder that provides a compression space for a refrigerant introduced into the shell; a moving member including a piston that compresses the refrigerant sucked into the compression space inside the cylinder, and that is linearly reciprocated with respect to the fixed member; and a suction muffler positioned on or in a suction passage of the refrigerant inside the shell. A suction volume with a larger sectional area in a central portion than in both ends is defined in the suction muffler.

21 Claims, 6 Drawing Sheets

LINEAR COMPRESSOR

TECHNICAL FIELD

The present invention relates to a linear compressor, and more particularly, to a linear compressor including a suction muffler defining a suction volume to maintain a flow of refrigerant to be constant.

BACKGROUND ART

In general, a compressor is a mechanical apparatus that receives power from a power generation apparatus such as an electric motor, a turbine or the like and compresses air, refrigerant or various operation gases to raise a pressure. The compressor has been widely used in electric home appliances such as a refrigerator and an air conditioner, or in the whole industry.

The compressors are roughly classified into a reciprocating compressor wherein a compression space to/from which an operation gas is sucked and discharged is defined between a piston and a cylinder, and the piston is linearly reciprocated inside the cylinder to compress refrigerant, a rotary compressor wherein a compression space to/from which an operation gas is sucked and discharged is defined between an eccentrically-rotated roller and a cylinder, and the roller is eccentrically rotated along an inner wall of the cylinder to compress refrigerant, and a scroll compressor wherein a compression space to/from which an operation gas is sucked and discharged is defined between an orbiting scroll and a fixed scroll, and the orbiting scroll is rotated along the fixed scroll to compress refrigerant.

Recently, a linear compressor has been actively developed among the reciprocating compressors. In the linear compressor, a piston is connected directly to a linearly-reciprocated driving motor to prevent a mechanical loss by motion conversion, improve the compression efficiency and simplify the configuration.

Normally, in the linear compressor, a piston is linearly reciprocated inside a cylinder by a linear motor in a hermetic shell so as to suck, compress and discharge refrigerant. In the linear motor, a permanent magnet is positioned between an inner stator and an outer stator, and driven to be linearly reciprocated due to a mutual electromagnetic force. Since the permanent magnet is driven in a state where it is connected to the piston, the piston is linearly reciprocated inside the cylinder to suck, compress and discharge refrigerant.

FIG. 1 is a side-sectional view illustrating a linear compressor applied with a conventional suction muffler, FIG. 2 is a side-sectional view illustrating the conventional suction muffler, and FIG. 3 is a graph showing a mass flow of refrigerant passing through the conventional suction muffler.

Referring to FIG. 1, in a conventional linear compressor 1, a piston 30 is linearly reciprocated inside a cylinder 20 by a linear motor 40 in a hermetic shell 10 so as to suck, compress and discharge refrigerant. The linear motor 40 includes an inner stator 42, an outer stator 44, and a permanent magnet 46 positioned between the inner stator 42 and the outer stator 44. The permanent magnet 46 is linearly reciprocated due to a mutual electromagnetic force. Here, since the permanent magnet 46 is driven in a state where it is connected to the piston 30, the piston 30 is linearly reciprocated inside the cylinder 20 to suck, compress and discharge refrigerant.

The linear compressor 1 further includes a frame 52, a stator cover 54 and a rear cover 56. In the linear compressor 1, the cylinder 20 can be fixed by the frame 52, or the cylinder 20 and the frame 52 can be integrally formed. A discharge valve 62 is elastically supported by an elastic member at the front of the cylinder 20, and selectively opened and closed due to a pressure of refrigerant in the cylinder 20. A discharge cap 64 and a discharge muffler 66 are installed at the front of the discharge valve 62, and fixed to the frame 52. One ends of the inner stator 42 and the outer stator 44 are supported by the frame 52, and also supported by a special member such as an O-ring of the inner stator 42 or an elevated portion of the cylinder 20. The other end of the outer stator 44 is supported by the stator cover 54. The rear cover 56 is installed on the stator cover 54, and a suction muffler 70 is positioned between the rear cover 56 and the stator cover 54.

In addition, a supporter piston 32 is coupled to the back of the position 30. Main springs 80 with respective natural frequencies are installed at the supporter piston 32 to allow the piston 30 to resonate. The main springs 80 are divided into a front spring 82 with both ends supported by the supporter piston 32 and the stator cover 54, and a rear spring 84 with both ends supported by the supporter piston 32 and the rear cover 56. Here, the main springs 80 include four front springs 82 and four rear springs 84. If a large number of main springs 80 are used, there are a lot of positional parameters that must be controlled to maintain balance during the motion of the piston 30. As a result, the manufacturing process is complicated and long, and the unit cost of manufacturing is high.

Moreover, the refrigerant is sucked via the suction muffler 70 from a suction pipe 15, compressed through the inside of the piston 30, and discharged through the discharge valve 62, the discharge cap 64 and the discharge muffler 66.

FIG. 2 shows the concrete configuration of the conventional suction muffler. In a case where the piston 30 existing on the inner diameter of the cylinder 20 is reciprocated, the suction muffler 70 fastened to the piston 30 sucks the refrigerant.

In detail, the suction muffler 70 includes a cylindrical muffler casing 72 of a relatively large diameter having an inlet and an outlet at front and rear ends in an axis direction to let refrigerant in and out, an inner suction pipe 73 installed inside the inlet 74 of the muffler casing 72, a vertical partition wall 76 for separating an inner space defined by the inside of the muffler casing 72 and the inner suction pipe 73, a horizontal partition wall 77 bonded to the vertical partition wall 76 to form the horizontal shape, and a cylindrical outer suction pipe 75 of a relatively small diameter installed outside the outlet of the muffler casing 72. Here, the refrigerant flows into the inlet 74 of the muffler casing 72, flows along the inner suction pipe 73, passes through the vertical partition wall 76 and the horizontal partition wall 77, and flows along the outer suction pipe 75.

The mass flow of the refrigerant passing through the conventional suction muffler can be better understood with reference to FIG. 3. The mass flow of the refrigerant passing through the outer suction pipe 75 has the same wave as that of an operating frequency of the linear motor. An inflow amount of refrigerant is larger or smaller than the average, which reveals the weakness in the performance of the conventional linear compressor.

As described above, since the amount of the refrigerant from the suction muffler is repeatedly smaller or larger than the average, the conventional linear compressor has a problem in supplying an efficient cooling force. Moreover, in order to supply a high cooling force, an excessive load is applied to a moving member for compressing refrigerant, which results in a short lifespan.

DISCLOSURE OF INVENTION

Technical Problem

An object of the present invention is to provide a suction muffler including an outer suction pipe defining a suction volume with a sectional area increased and decreased to store refrigerant, so that a flow of the refrigerant toward a compression space can be maintained to be constant.

Technical Solution

According to one aspect of the present invention, there is provided a linear compressor, including: a shell; a fixed member installed inside the shell, and including a cylinder for providing a compression space of refrigerant introduced into the shell; a moving member including a piston for compressing the refrigerant sucked into the compression space inside the cylinder, and being linearly reciprocated with respect to the fixed member; and a suction muffler positioned on a suction passage of the refrigerant inside the shell, a suction volume with a larger sectional area in a central portion than in both ends being defined in the suction muffler.

In addition, according to another aspect of the present invention, the suction muffler includes: a muffler casing connected to one side of the piston; an inner suction pipe positioned inside the muffler casing; and an outer suction pipe extended long from the muffler casing to the outside, the suction volume being defined in the outer suction pipe.

Moreover, according to a further aspect of the present invention, the fixed member further includes a supporter piston connected to the piston and provided with a supporting portion expanded in a radius direction of the piston, the piston being connected to a front surface of the supporter piston, the suction muffler being coupled to the fixed moving member by coupling the muffler casing to a rear surface of the supporter piston, the outer suction pipe being extended long inside the piston.

Here, the outer suction pipe has a section gradually increased from both ends to a central portion so that the suction volume can be defined in the central portion, has an almost rhombus section so that the suction volume can be defined in the central portion, or has an almost octagonal section where sides parallel to a longitudinal direction of the piston are relatively long so that the suction volume can be defined in the central portion.

Further, according to a still further aspect of the present invention, the outer suction pipe is formed by integrally injection-molding a plastic, and fixedly installed between the supporter piston and the muffler casing by coupling the muffler casing to the supporter piston in a state where an edge of an inlet end of the outer suction pipe is positioned between the supporter piston and the muffler casing. Preferably, the muffler casing includes a step difference for accommodating the edge of the inlet end of the outer suction pipe.

Advantageous Effects

The suction muffler of the linear compressor according to the present invention is provided with the suction volume to maintain the flow of the refrigerant to be constant, which results in a high efficiency cooling force.

In addition, the number of the main springs of the linear compressor according to the present invention is reduced to cut down the production cost of the components and to simplify the installation process of the components.

MODE FOR THE INVENTION

Hereinafter, preferred embodiments of the present invention will be described in detail with reference to the accompanying drawings.

Figure 1:
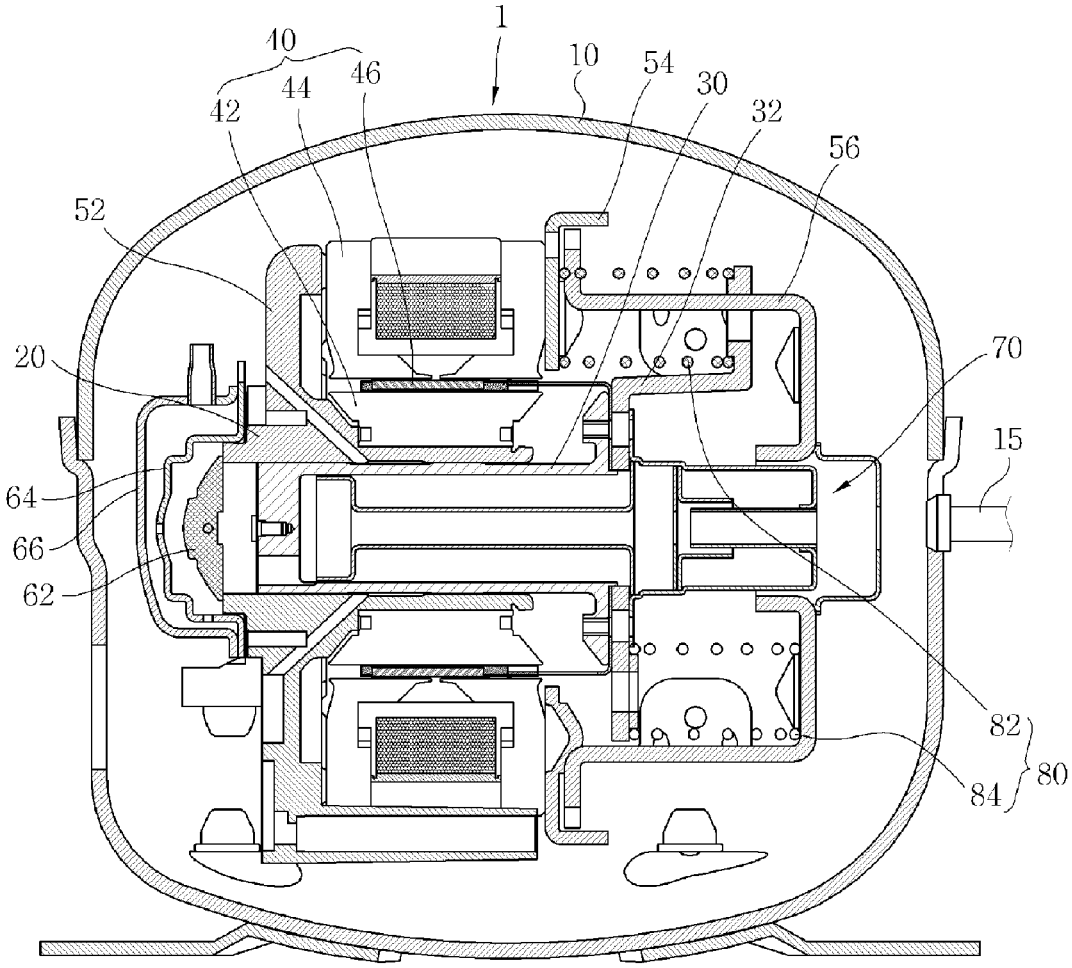
FIG. 1 is a side-sectional view illustrating a linear compressor applied with a conventional suction muffler.
Figure 2:
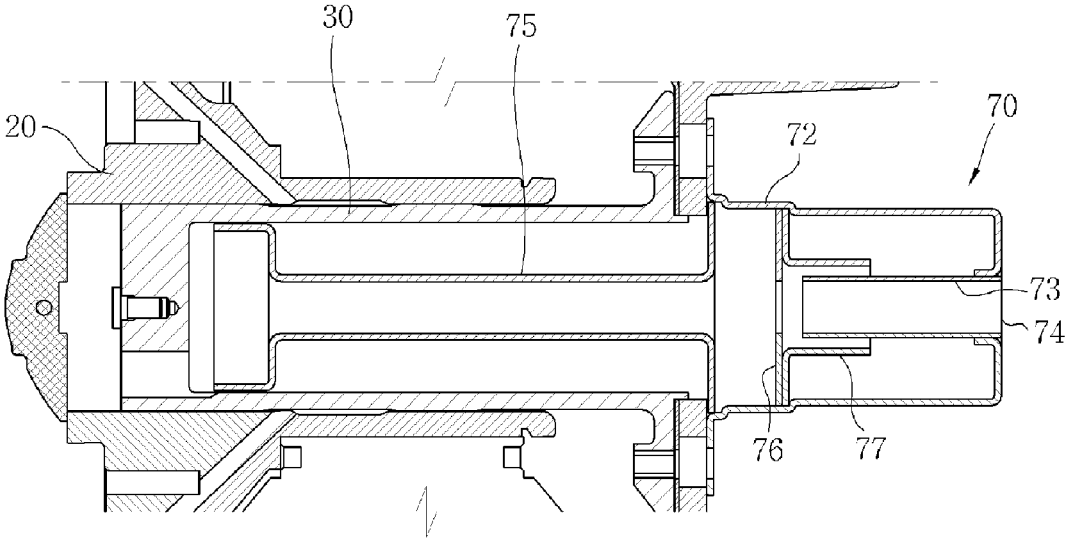
FIG. 2 is a side-sectional view illustrating the conventional suction muffler.
Figure 3:
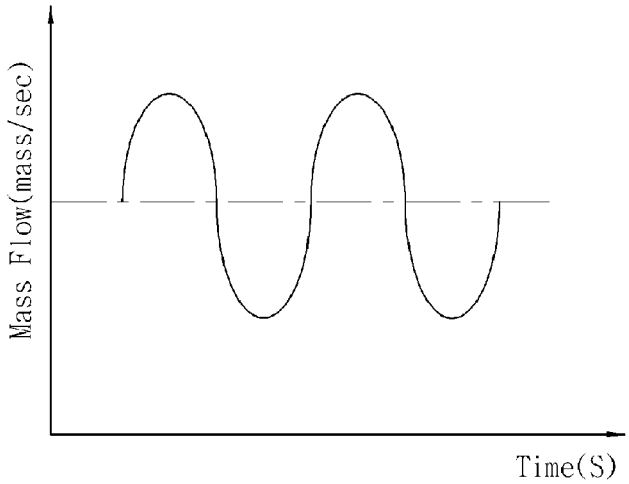
FIG. 3 is a graph showing a mass flow of refrigerant passing through the conventional suction muffler.
Figure 4:
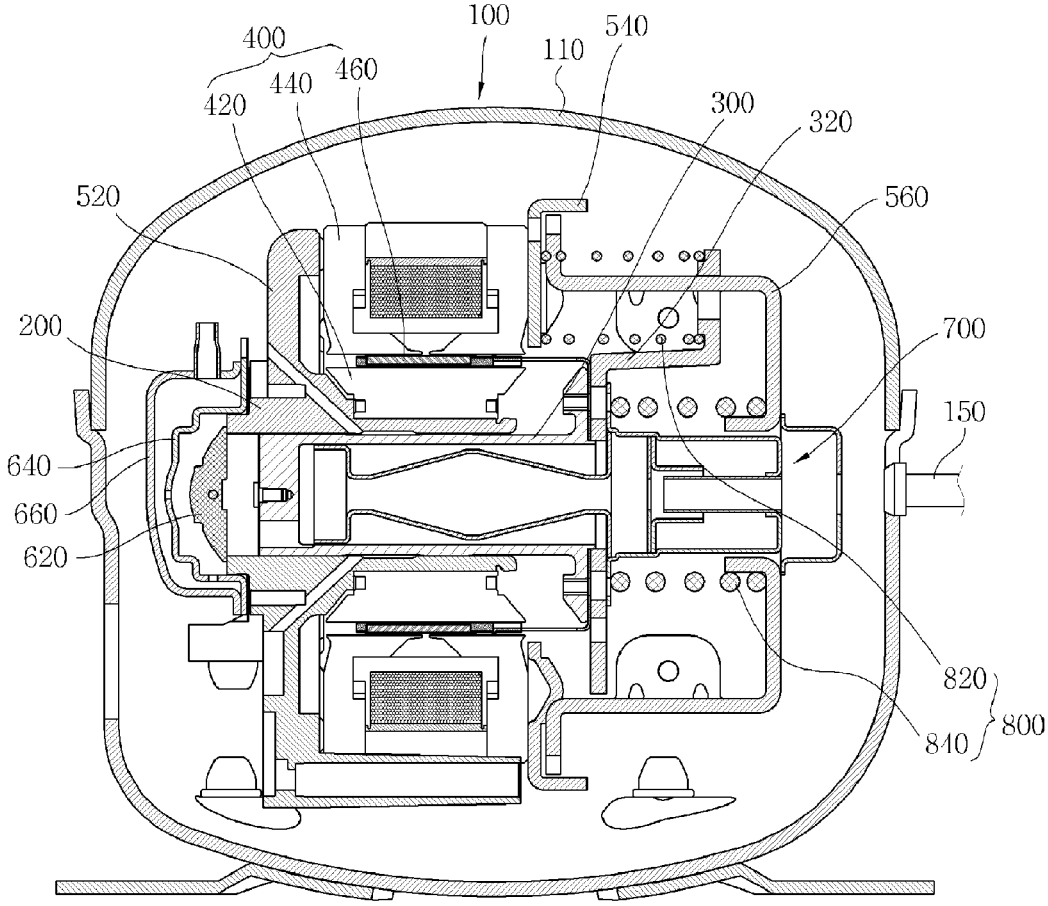
FIG. 4 is a side-sectional view illustrating a linear compressor applied with a suction muffler according to the present invention.
Figure 5:
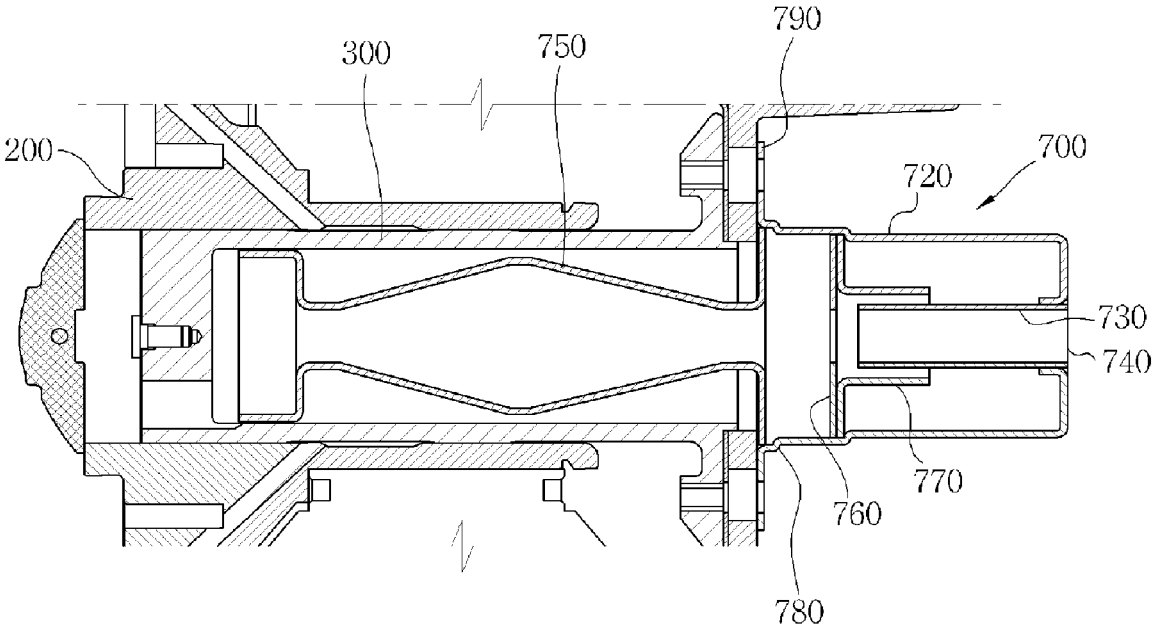
FIG. 5 is a side-sectional view illustrating the suction muffler according to the present invention.
Figure 6:
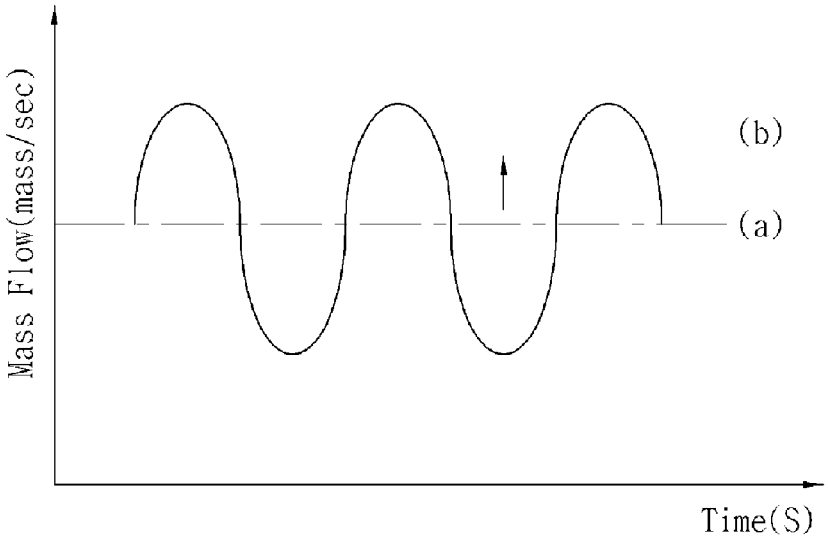
FIG. 6 is a graph showing a mass flow of refrigerant passing through the suction muffler according to the present invention.

FIG. 4 is a side-sectional view illustrating a linear compressor applied with a suction muffler according to the present invention, FIG. 5 is a side-sectional view illustrating the suction muffler according to the present invention, and FIG. 6 is a graph showing a mass flow of refrigerant passing through the suction muffler according to the present invention.

Referring to FIG. 4, in a linear compressor 100 according to the present invention, a piston 300 is linearly reciprocated inside a cylinder 200 by a linear motor 400 in a hermetic shell 110 so as to suck, compress and discharge refrigerant. The linear motor 400 includes an inner stator 420, an outer stator 440, and a permanent magnet 460 positioned between the inner stator 420 and the outer stator 440. The permanent magnet 460 is linearly reciprocated due to a mutual electromagnetic force. Here, since the permanent magnet 460 is driven in a state where it is connected to the piston 300, the piston 300 is linearly reciprocated inside the cylinder 200 to suck, compress and discharge refrigerant.

The linear compressor 100 further includes a frame 520, a stator cover 540 and a rear cover 560. In the linear compressor 100, the cylinder 200 can be fixed by the frame 520, or the cylinder 200 and the frame 520 can be integrally formed. A discharge valve 620 is elastically supported by an elastic member at the front of the cylinder 200, and selectively opened and closed due to a pressure of refrigerant in the cylinder 200. A discharge cap 640 and a discharge muffler 660 are installed at the front of the discharge valve 620, and fixed to the frame 520. One ends of the inner stator 420 and the outer stator 440 are supported by the frame 520, and also supported by a special member such as an O-ring of the inner stator 420 or an elevated portion of the cylinder 200. The other end of the outer stator 440 is supported by the stator cover 540. The rear cover 560 is installed on the stator cover 540, and a suction muffler 700 is positioned between the rear cover 560 and the stator cover 540.

In addition, a supporter piston 320 is coupled to the back of the piston 300. Main springs 800 with respective natural frequencies are installed at the supporter piston 320 to allow the piston 300 to resonate. The main springs 800 are divided into a front main spring 820 with both ends supported by the supporter piston 320 and the stator cover 540, and a rear main spring 840 with both ends supported by the supporter piston 320 and the rear cover 560. In this embodiment, the center of the rear main spring 840 corresponds to the center of the piston 300. Since only one rear main spring 840 is used, the number of the main springs 800 is reduced. Consequently, the component production cost can be lowered and the piston 300 can be precisely reciprocated. However, the present invention is not limited to the above-described structure, but can be applied to other spring support structures.

Moreover, a suction muffler 700 is provided at the back of the piston 300. The refrigerant is introduced into the piston 300 through the suction muffler 700, which suppresses refrigerant suction noise. At this time, an outer diameter of some portion of the suction muffler 700 is fitted into an inner diameter of the rear main spring 840.

The piston 300 is hollowed so that the refrigerant introduced through the suction muffler 700 can be sucked into and compressed in a compression space defined between the cylinder 200 and the piston 300. A valve (not shown) is installed at a front end of the piston 300. The valve (not shown) opens the front end of the piston 300 so as to allow the refrigerant to flow from the piston 300 to the compression space, and blocks the front end of the piston 300 so as to prevent the refrigerant from returning from the compression space to the piston 300.

When the refrigerant is compressed over a predetermined pressure in the compression space by the piston 300, the discharge valve 620 positioned at a front end of the cylinder 200 is opened. The discharge valve 620 is installed inside the supporting cap 640 fixed to one end of the cylinder 200 to be elastically supported by a spiral discharge valve spring 630. The high pressure compressed refrigerant is transferred into the discharge cap 660 through a hole formed in the supporting cap 640, discharged to the outside of the linear compressor 100 through a loop pipe (not shown), and circulated in a freezing cycle.

The respective components of the linear compressor 100 are supported by a front supporting spring (not shown) and a rear supporting spring (not shown) in an assembled state, and spaced apart from the bottom of the shell 110. Since the components are not in contact with the bottom of the shell 110, vibration generated in each component of the linear compressor 100 compressing the refrigerant is not transferred directly to the shell 110. Therefore, vibration transferred to the outside of the shell 110 and noise generated by vibration of the shell 110 can be remarkably reduced.

The supporter piston 320 is coupled to the back of the piston 300, and transfers a force from the main springs 820 and 840 to the piston 300 so that the piston 300 can be linearly reciprocated in the resonance condition.

The center of the supporter piston 320 corresponds to the center of the piston 300. Preferably, a step difference is formed at a rear end of the piston 300 so that the centers of the supporter piston 320 and the piston 300 can be easily adjusted to each other.

In terms of the main springs 800 applying a restoration force to the supporter piston 320 so that the piston 300 coupled to the supporter piston 320 can be driven in the resonance condition, the number of the front main springs 820 is reduced into two and the number of the rear main springs 840 is reduced into one. Consequently, the entire main springs have a low rigidity. In addition, when the rigidity of the front main springs 820 and the rigidity of the rear main spring 840 are reduced respectively, the manufacturing cost of the main springs can be cut down.

Here, in a case where the rigidity of the front main springs 820 and the rear main spring 840 is reduced, when the mass of the driving unit such as the piston 300, the supporter piston 320 and the permanent magnet 460 is reduced, the driving unit can be driven in the resonance condition. Accordingly, the supporter piston 320 is preferably manufactured of a non-ferrous metal having a lower density than a ferrous metal, instead of the ferrous metal. As a result, the mass of the driving unit is reduced, corresponding to the low rigidity of the front main springs 820 and the rear main spring 840, so that the driving unit can be driven in the resonance condition. For example, when the supporter piston 320 is manufactured of a metal such as Al, even if the piston 300 is manufactured of a metal, the supporter piston 320 is not affected by the permanent magnet 460. Therefore, the piston 300 and the supporter piston 320 can be more easily coupled to each other.

When the supporter piston 320 is manufactured of a non-ferrous metal having a low density, it can satisfy the resonance condition and can be easily coupled to the piston 300. However, the portions of the supporter piston 320 brought into contact with the front main springs 820 are easily abraded due to friction against the front main springs 820 during the driving. Here, the front main springs 820 can be provided in a pair to be symmetric in up-down or left-right portions of the supporter piston 320. If the supporter piston 320 is abraded, the abraded pieces float in the refrigerant and circulate in the freezing cycle, which may damage the components existing on the freezing cycle. Thus, the portions of the supporter piston 320 brought into contact with the front main springs 820 are surface-processed. An NIP coating or anodizing treatment is carried out thereon so that a surface hardness of the portions of the supporter piston 320 brought into contact with the front main spring 820 can be higher than at least a hardness of the front main springs 820. This configuration prevents the supporter spring 320 from being abraded into pieces due to the front main springs 820.

The suction muffler 700 is mounted at the back of the supporter piston 320 by means of a fastening bolt. The refrigerant to be compressed is sucked into the piston 300 with noise reduced by the suction muffler 700.

When the supporter piston 320 and the suction muffler 700 are fixed by the fastening bolt, preferably, a mounting portion and a guide groove are provided to prevent them from being dislocated in the up-down or left-right direction. As described above, since the center of the suction muffler 700 corresponds to the center of the supporter piston 320, the center of the piston 300 corresponding to the center of the supporter piston 320 also corresponds to the center of the suction muffler 700.

In addition, the rear main spring 840 is mounted on the outer diameter of the suction muffler 700. The inner diameter of the rear main spring 840 is fitted into the outer diameter of the suction muffler 700. Therefore, the center of the suction muffler 700 corresponds to the center of the rear main spring 840.

Accordingly, the piston 300 can be linearly reciprocated, maintaining the resonance condition with the front main springs 820 reduced in number and rigidity on the basis that the number of the rear main springs 840 is reduced into one and the rigidity thereof is subsequently lowered. In this configuration, since the number and rigidity of the main springs are reduced, the manufacturing cost of the main springs can be remarkably cut down.

Here, the refrigerant is introduced into the hermetic shell 110 through a suction pipe 150, sucked via the suction muffler 700, sucked into and compressed in a compression space defined by the piston 300 and the cylinder 200, and discharged through the discharge valve 620, the discharge cap 640 and the discharge muffler 660.

FIG. 5 shows the detailed configuration of the suction muffler 700 which is the major object of the present invention. When the piston 300 is reciprocated inside the cylinder 200, the suction muffler 700 fastened to the rear surface of the supporter piston 320 is reciprocated together, so that low pressure refrigerant filled in the hermetic shell 110 is sucked into the compression space defined by the piston 300 and the cylinder 200 through the suction muffler 700.

In detail, the suction muffler 700 includes a cylindrical muffler casing 720 of a relatively large diameter having an inlet and an outlet at front and rear ends in an axis direction to let refrigerant in and out, an inner suction pipe 730 installed inside the inlet 740 of the muffler casing 720, a vertical partition wall 760 for separating an inner space defined by the inside of the muffler casing 720 and the inner suction pipe 730, a horizontal partition wall 770 bonded to the vertical partition wall 760 to surround a part of the inner suction pipe 730, and an outer suction pipe 750 extended long to the outside of the outlet of the muffler casing 720. Here, a flange portion 790 for coupling the suction muffler assembly to the supporter piston 320, and a step difference 780 for coupling the outer suction pipe 750 between the supporter piston 320 and the muffler casing 720 are formed at the muffler casing 720. In this case, refrigerant is introduced into the inlet 740 of the muffler casing 720, flows along the inner suction pipe 730, passes through the space defined by the vertical partition wall 760 and the horizontal partition wall 770, and flows along the outer suction pipe 750. Preferably, the muffler casing 720 is made of a metal to be firmly coupled to the supporter piston 320. The other components such as the inner suction pipe 730, the vertical partition wall 760, the horizontal partition wall 770 and the outer suction pipe 750 can be made of a plastic or metal. However, taking processing and assembly convenience into consideration, it is better to form such components by means of a plastic injection molding and to assemble them by means of a press-fit, etc.

Here, the outer suction pipe 750 includes a suction volume 755 with a larger sectional area in a central portion than in both ends. The suction volume 755 can serve as a temporary storage for maintaining a flow of refrigerant to be constant. That is, if a flow amount of refrigerant is large, the refrigerant is stored in the suction volume 755, and if a flow amount of refrigerant is deficient, the refrigerant stored in the suction volume 755 is discharged.

Variations of the mass flow of the refrigerant passing through the suction muffler 700 according to the present invention can be better understood with reference to FIG. 6. The mass flow of the refrigerant passing through the outer suction pipe 750 shows the same wave as that of the operating frequency of the linear motor as in the prior art. However, if the flow amount of the refrigerant is deficient, the refrigerant stored in the suction volume 755 is discharged, so that the mass flow average of the refrigerant increases. In the graph of FIG. 6, in a case where the refrigerant is sucked through the suction muffler 700 having the suction volume 755 according to the present invention, the mass flow average of the refrigerant increases from (a) to (b).

Figure 7:
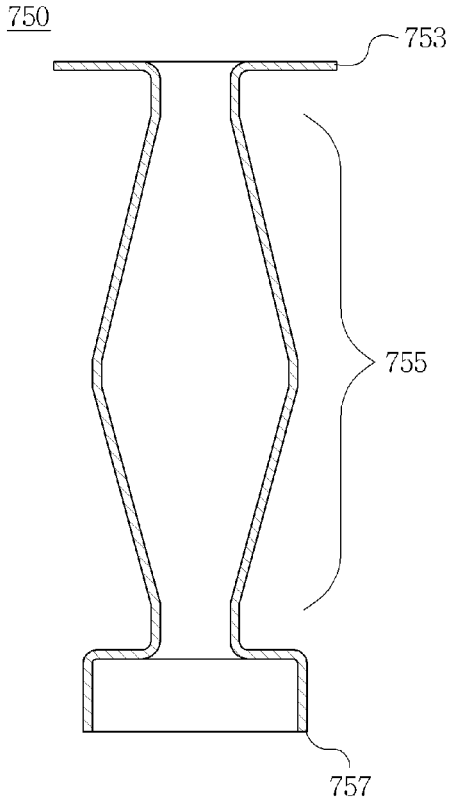
FIG. 7 is a side-sectional view illustrating an outer suction pipe of a suction muffler according to an embodiment of the present invention.

FIG. 7 is a side-sectional view illustrating an outer suction pipe with a suction volume formed therein according to an embodiment of the present invention. An inlet end 753 and an outlet end 757 are identical to those of the conventional outer suction pipe. However, a suction volume 755 defined between the inlet end 753 and the outlet end 757 slowly inclines from both ends and has the largest sectional area in a central portion to thereby temporarily store refrigerant. Here, the section of the suction volume 755 is an almost rhombus.

Figure 8:
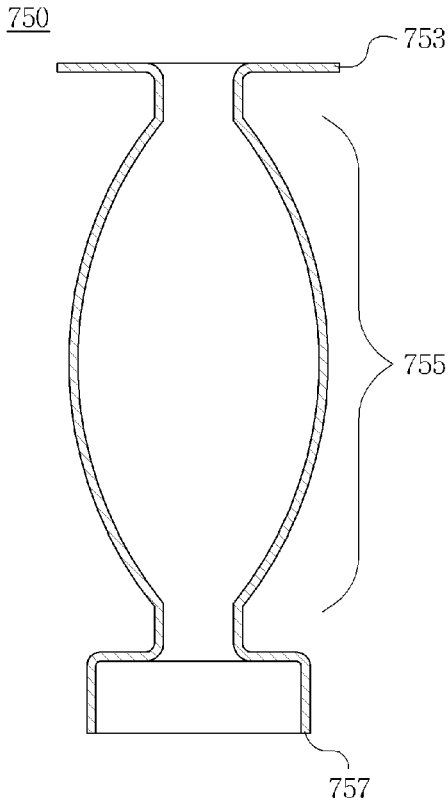
FIG. 8 is a side-sectional view illustrating an outer suction pipe of a suction muffler according to another embodiment of the present invention.

FIG. 8 is a side-sectional view illustrating an outer suction pipe with a suction volume formed therein according to another embodiment of the present invention. A suction volume 755 between an inlet end 753 and an outlet end 757 has a section gradually increased toward a central portion. The section of the suction volume 755 forms arcs facing each other.

Figure 9:
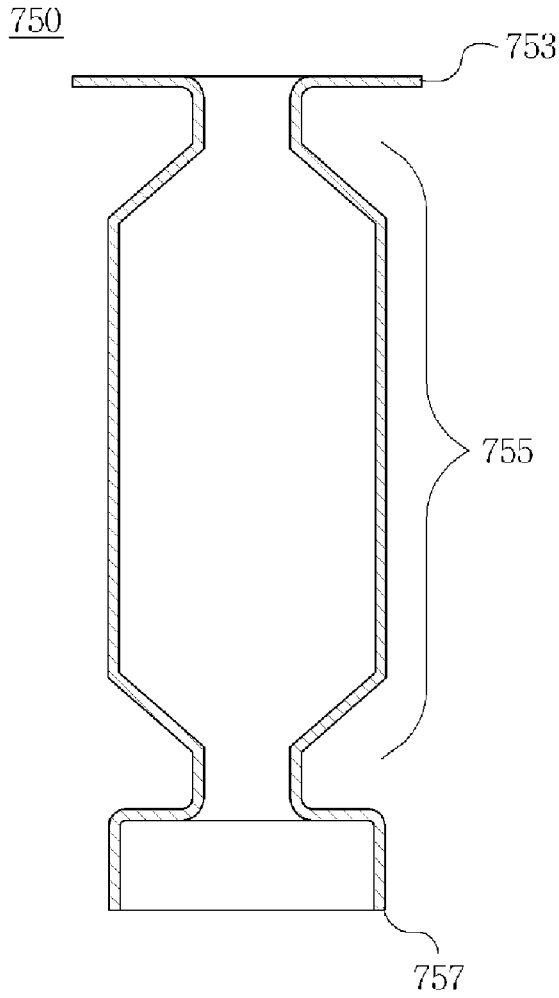
FIG. 9 is a side-sectional view illustrating an outer suction pipe of a suction muffler according to a further embodiment of the present invention.

FIG. 9 is a side-sectional view illustrating an outer suction pipe with a suction volume formed therein according to a further embodiment of the present invention. A suction volume 755 between an inlet end 753 and an outlet end 757 has an almost octagonal section where sides parallel to a longitudinal direction of a piston are relatively long.

Figure 10:
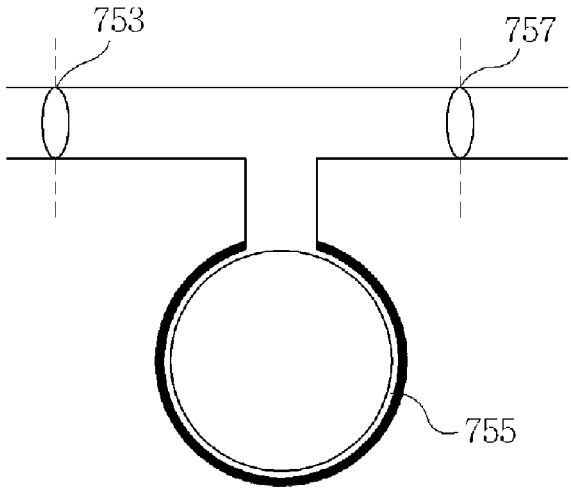
FIG. 10 is a view illustrating a simplified flow modeling in an outer suction pipe of a suction muffler according to the present invention.

FIG. 10 is a view illustrating a simplified flow modeling in an outer suction pipe of a suction muffler according to the present invention.

When a suction volume 755 is provided between an inlet end 753 and an outlet end 757 of an outer suction pipe 750, in a case where inflow of refrigerant into the inlet end 753 is deficient, refrigerant stored in the suction volume 755 is discharged, so that a flow of refrigerant can be constant in the outlet end 757.

Figure 11:
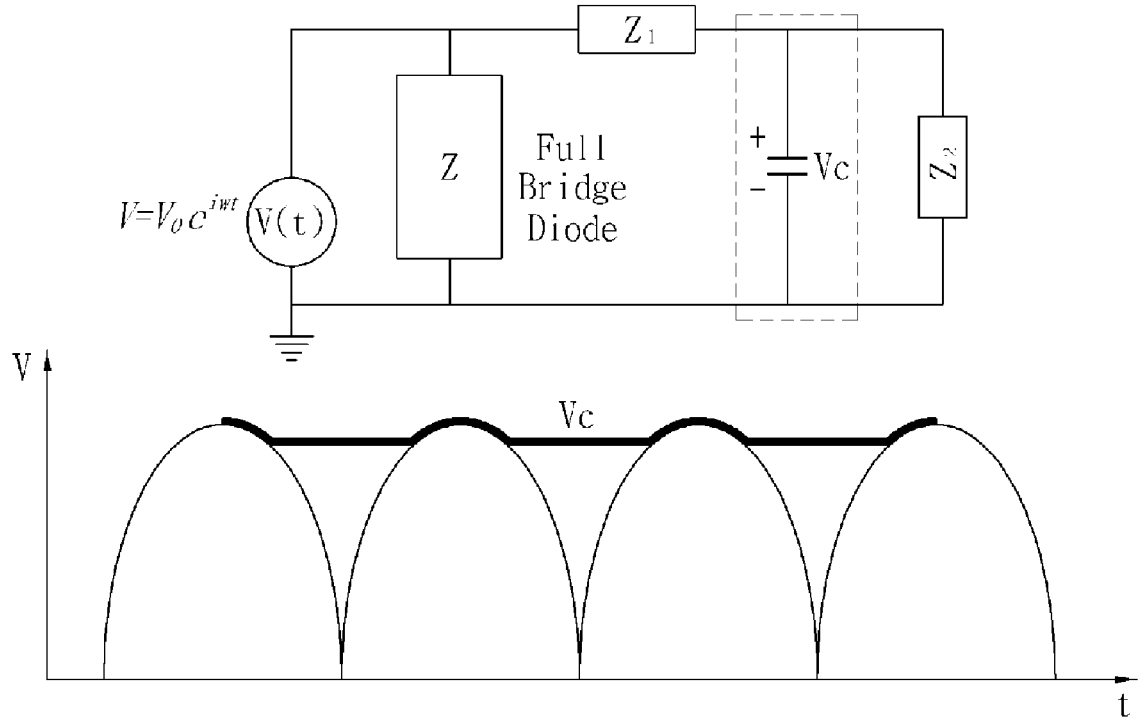
FIG. 11 is a view illustrating an equivalent modeling of an outer suction pipe of a suction muffler according to the present invention to a capacitor of an electric circuit.

FIG. 11 is a view illustrating an equivalent modeling of an outer suction pipe of a suction muffler according to the present invention to a capacitor of an electric circuit.

A suction volume of the outer suction pipe provided in the suction muffler according to the present invention can be modeled into the capacitor of the electric circuit. First, the capacitor of the electric circuit indicated by a dotted line at the top of the drawing charges and discharges a current to maintain an output voltage to be constant as shown in a graph at the bottom of the drawing. In the same manner, according to the present invention, the outer suction pipe of the suction muffler is provided with the suction volume to store and discharge refrigerant, thereby maintaining a flow of refrigerant to be constant.

Here, the outer suction pipe 750 cannot be easily shaped by a metal processing. Meanwhile, the outer suction pipe 750 can be easily formed by integrally injection-molding a plastic material, or by injection-molding two or more plastic members and bonding them. It has been publicly known that an expansion portion can be provided to the outlet end 757 of the outer suction pipe 750. According to the present invention, the outer suction pipe 750 can be easily assembled between the supporter piston 320 and the muffler casing 720 by using an edge of the inlet end 753. That is, since an outer diameter of the inlet end 753 is slightly larger than an inner diameter of the supporter piston 320, the edge of the inlet end 753 is put on the supporter piston 320 to be suspended on the rear surface of the supporter piston 320, and the muffler casing 720 is fastened to the supporter piston 320, so that the outer suction pipe 750 is fixedly installed between the supporter piston 320 and the muffler casing 720. In this case, when the step difference 780 sufficiently large to accommodate the edge portion of the inlet end 753 is formed at the muffler casing 720, the outer suction pipe 750 can be completely installed.

As discussed earlier, the muffler casing 720 is preferably formed of a metal material to be firmly fastened to the supporter piston 320. In a case where the outer suction pipe 750 is injection-molded with a plastic, the outer suction pipe 750 can be easily fixedly installed between the supporter piston 320 and the muffler casing 720 by means of the aforementioned coupling structure.

That is, in the assembly, the piston 300, the supporter piston 320, the outer suction pipe 750 and the muffler casing 720 are put on an assembly jig in order, and coupled by means of separate fastening bolts, thereby obtaining a firmly-coupled moving member.

As set forth herein, the suction muffler of the linear compressor according to the present invention includes the outer suction pipe to provide the suction volume for storing and discharging the refrigerant. The suction volume maintains the flow of the refrigerant to be constant, so that the linear compressor can obtain high efficiency performance. Moreover, load is not excessively applied to the moving member for compressing the refrigerant for a high cooling force.

The present invention is not limited to the preferred embodiments and the accompanying drawings. Therefore, it will be understood by those skilled in the art that various displacements, modifications and changes can be made thereto without departing from the technical ideas of the invention.

The invention claimed is:

1. A linear compressor, comprising:

a shell;

a fixed member installed inside the shell, and including a cylinder that provides a compression space for a refrigerant introduced into the shell;

a moving member including a piston that compresses the refrigerant inside the cylinder, and a supporter piston fixed to the piston that includes a supporting portion that expands in a radius direction of the piston, the moving member being linearly reciprocated with respect to the fixed member;

a plurality of front main springs each having one end supported at a surface of the supporting portion of the supporter piston and the other end supported at the fixed member, and being symmetric with respect to centers of the piston and the supporter piston;

a rear main spring having one end supported by the supporter piston; and a suction muffler positioned in a suction passage of the refrigerant inside the shell, wherein a suction volume having a larger sectional area in a central portion than a sectional area in both ends is defined in the suction muffler, and wherein the central portion of the suction volume is disposed inside the piston.

2. The linear compressor of claim 1, wherein the rear main spring has an almost same rigidity as a sum of rigidities of the plurality of front main springs so that the moving member is driven in a resonance condition.

3. The linear compressor of claim 1, wherein a center of the rear main spring corresponds to a center of the piston.

4. The linear compressor of claim 1, wherein the other end of the plurality of front main springs is installed outside the cylinder.

5. The linear compressor of claim 1, wherein the suction muffler is bolt-fastened to the supporter piston.

6. The linear compressor of claim 1, wherein the suction muffler comprises:

a muffler casing connected to one side of the piston;

an inner suction pipe positioned inside the muffler casing; and an outer suction pipe that extends longitudinally away from the muffler casing to an outside thereof, wherein the suction volume is defined in the outer suction pipe.

7. The linear compressor of claim 6, wherein the piston is connected to a first surface of the supporter piston, wherein the suction muffler is coupled to the moving member by coupling the muffler casing to a second surface of the supporter piston, and wherein the outer suction pipe extends longitudinally inside the piston.

8. The linear compressor of claim 6, wherein the outer suction pipe has a section that gradually increases from both ends to a central portion thereof, so that the suction volume is defined in the central portion.

9. The linear compressor of claim 6, wherein the outer suction pipe is formed by integrally injection-molding a plastic, and fixedly installed between the supporter piston and the muffler casing by coupling the muffler casing to the supporter piston in a state in which an edge of an inlet end of the outer suction pipe is positioned between the supporter piston and the muffler casing.

10. The linear compressor of claim 9, wherein the muffler casing comprises a step difference that accommodates the edge of the inlet end of the outer suction pipe.

11. A linear compressor, comprising:

a shell;

a fixed member installed inside the shell, and including a cylinder that provides a compression space for a refrigerant introduced into the shell;

a moving member including a piston that compresses the refrigerant inside the cylinder, and a supporter piston fixed to the piston that includes a supporting portion that expands in a radius direction of the piston, the moving member being linearly reciprocated with respect to the fixed member;

a plurality of front main springs each having one end supported at a surface of the supporting portion of the supporter piston and the other end supported at the fixed member, and being symmetric with respect to centers of the piston and the supporter piston;

a rear main spring having one end supported by the supporter piston; and a suction muffler positioned in a suction passage of the refrigerant inside the shell, wherein a suction volume having a larger sectional area in a central portion than a sectional area in both ends is defined in the suction muffler, and wherein the suction muffler comprises:

a muffler casing connected to one side of the piston;

an inner suction pipe positioned inside the muffler casing; and an outer suction pipe that extends longitudinally away from the muffler casing to an outside thereof, wherein the suction volume is defined in the outer suction pipe, and wherein the outer suction pipe has an almost rhombus section, so that the suction volume is defined in a central portion thereof.

12. A linear compressor, comprising:

a shell;

a fixed member installed inside the shell, and including a cylinder that provides a compression space for a refrigerant introduced into the shell;

a moving member including a piston that compresses the refrigerant inside the moving cylinder, and a supporter piston fixed to the piston that includes a supporting portion that expands in a radius direction of the piston, the moving member being linearly reciprocated with respect to the fixed member;

a plurality of front main springs each having one end supported at a surface of the supporting portion of the supporter piston and the other end supported at the fixed member, and being symmetric with respect to centers of the piston and the supporter piston;

a rear main spring having one end supported by the supporter piston; and a suction muffler positioned in a suction passage of the refrigerant inside the shell, wherein a suction volume having a larger sectional area in a central portion than a sectional area in both ends is defined in the suction muffler, wherein the suction muffler comprises:

a muffler casing connected to one side of the piston;

an inner suction pipe positioned inside the muffler casing; and an outer suction pipe that extends longitudinally away from the muffler casing to an outside thereof, wherein the suction volume is defined in the outer suction pipe, and wherein the outer suction pipe has an almost octagonal section, in which sides parallel to a longitudinal direction of the piston are relatively long, so that the suction volume is defined in a central portion thereof.

13. A linear compressor, comprising:

a shell;

a fixed member installed inside the shell, and including a cylinder that provides a compression space for a refrigerant introduced into the shell;

a moving member including a piston that compresses the refrigerant sucked into the compression space provided inside the cylinder, and being linearly reciprocated with respect to the fixed member; and a suction muffler positioned in a suction passage of the refrigerant inside the shell, wherein a suction volume having a larger sectional area in a central portion than a sectional area in both ends is defined in the suction muffler, and wherein the central portion of the suction volume is disposed inside the piston.

14. The linear compressor of claim 13, wherein the suction muffler comprises:

a muffler casing connected to one side of the piston;

an inner suction pipe positioned inside the muffler casing; and an outer suction pipe that extends longitudinally away from the muffler casing to an outside thereof, wherein the suction volume is defined in the outer suction pipe.

15. The linear compressor of claim 14, wherein the moving member further comprises a supporter piston connected to the piston and including a supporting portion that expands in a radius direction of the piston, and wherein the piston is connected to a first surface of the supporter piston, the suction muffler is coupled to the moving member by coupling the muffler casing to a second surface of the supporter piston, and the outer suction pipe extends longitudinally inside the piston.

16. The linear compressor of claim 14, wherein the outer suction pipe has a section that gradually increases from both ends to a central portion thereof, so that the suction volume is defined in the central portion.

17. The linear compressor of claim 15, wherein the outer suction pipe is formed by integrally injection-molding a plastic, and fixedly installed between the supporter piston and the muffler casing by coupling the muffler casing to the supporter piston in a state in which an edge of an inlet end of the outer suction pipe is positioned between the supporter piston and the muffler casing.

18. The linear compressor of claim 15, wherein the suction muffler is bolt-fastened to the supporter piston.

19. The linear compressor of claim 17, wherein the muffler casing comprises a step difference that accommodates the edge of the inlet end of the outer suction pipe.

20. A linear compressor, comprising:

a shell;

a fixed member installed inside the shell, and including a cylinder that provides a compression space for a refrigerant introduced into the shell;

a moving member including a piston that compresses the refrigerant sucked into the compression space provided inside the cylinder, and being linearly reciprocated with respect to the fixed member; and a suction muffler positioned in a suction passage of the refrigerant inside the shell, wherein a suction volume having a larger sectional area in a central portion than a sectional area in both ends is defined in the suction muffler wherein the suction muffler comprises:

a muffler casing connected to one side of the piston;

an inner suction pipe positioned inside the muffler casing; and an outer suction pipe that extends longitudinally away from the muffler casing to an outside thereof, wherein the suction volume is defined in the outer suction pipe, and wherein the outer suction pipe has an almost rhombus section, so that the suction volume is defined in a central portion thereof.

21. A linear compressor, comprising:

a shell;

a fixed member installed inside the shell, and including a cylinder that provides a compression space for a refrigerant introduced into the shell;

a moving member including a piston that compresses the refrigerant sucked into the compression space provided inside the cylinder, and being linearly reciprocated with respect to the fixed member; and a suction muffler positioned in a suction passage of the refrigerant inside the shell, wherein a suction volume having a larger sectional area in a central portion than a sectional area in both ends is defined in the suction muffler, wherein the suction muffler comprises:

a muffler casing connected to one side of the piston;

an inner suction pipe positioned inside the muffler casing; and an outer suction pipe that extends longitudinally away from the muffler casing to an outside thereof, wherein the suction volume is defined in the outer suction pipe, and wherein the outer suction pipe has an almost octagonal section, in which sides parallel to a longitudinal direction of the piston are relatively long, so that the suction volume is defined in a central portion thereof.

* * * * *